US007487640B2

(12) United States Patent
Schöttler et al.

(10) Patent No.: US 7,487,640 B2
(45) Date of Patent: Feb. 10, 2009

(54) METHOD AND DEVICE FOR REMOVING WATER FROM A STEAM PLANT

(75) Inventors: Michael Schöttler, Erlangen (DE); Anja Wallmann, Erlangen (DE); Rainer Wulff, Pommelsbrunn (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/586,857

(22) PCT Filed: Sep. 30, 2004

(86) PCT No.: PCT/EP2004/010936

§ 371 (c)(1),
(2), (4) Date: May 21, 2007

(87) PCT Pub. No.: WO2005/068905

PCT Pub. Date: Jul. 28, 2005

(65) Prior Publication Data

US 2007/0289304 A1 Dec. 20, 2007

(30) Foreign Application Priority Data

Jan. 20, 2004 (EP) ..... 04001042

(51) Int. Cl.
*F01K 13/02* (2006.01)

(52) U.S. Cl. ..... 60/646; 60/657

(58) Field of Classification Search ..... 60/646, 60/657–658
See application file for complete search history.

(56) References Cited

U.S. PATENT DOCUMENTS

| | | | | |
|---|---|---|---|---|
| 3,008,295 | A | 11/1961 | Profos | |
| 4,319,895 | A | 3/1982 | Kemmer | |
| 4,353,213 | A * | 10/1982 | Masuda et al. | 60/646 |
| 4,430,962 | A * | 2/1984 | Miszak | 122/406.4 |
| 4,813,237 | A * | 3/1989 | Szucs et al. | 60/670 |
| 5,048,466 | A * | 9/1991 | Rudd | 122/406.5 |
| 5,189,873 | A * | 3/1993 | Mishima et al. | 60/39.182 |
| 6,155,054 | A | 12/2000 | Liebig | |
| 6,223,536 | B1 * | 5/2001 | Liebig | 60/646 |

FOREIGN PATENT DOCUMENTS

| | | |
|---|---|---|
| BE | 515097 | 7/1954 |
| JP | 09079504 A | 3/1997 |

OTHER PUBLICATIONS

Hitzel H et al.; "Kondensatreinigung mit Separaten Kationen-und Anionenaustauschem fuer das Direkt Luftgekuehlte Kraftwerk Matimba der Eskom"; Feb. 1, 1990; pp. 138-145; vol. 70, No. 2; XP000161705; ISSN: 0372-5715.

* cited by examiner

*Primary Examiner*—Hoang M Nguyen

(57) ABSTRACT

The invention relates to a method and device for removing water from a steam plant and to a steam plant with which, according to the degree of impurity of a number of partial volumes of water, a separate collection of the relevant partial water volumes is carried out.

15 Claims, 2 Drawing Sheets

METHOD AND DEVICE FOR REMOVING WATER FROM A STEAM PLANT

CROSS REFERENCE TO RELATED APPLICATIONS

This application is the US National Stage of International Application No. PCT/EP2004/010936, filed Sep. 30, 2004 and claims the benefit thereof. The International Application claims the benefits of European Patent application No. 04001042.3 filed Jan. 20, 2004. All of the applications are incorporated by reference herein in their entirety.

FIELD OF THE INVENTION

The present invention relates to a method and to a device for removing water from a steam plant. The present invention also relates to a steam plant.

BACKGROUND OF THE INVENTION

A steam plant of this type conventionally includes one or more steam drum(s) with associated evaporators with which, in particular at different pressure levels, steam is generated which can be supplied to a steam turbine. Impurities in the water-steam circuit of the steam plant have to be removed. Concentration of the impurities takes place in the steam drum. Non-volatile substances remain in the steam drum owing to removal of wet steam from the steam drum. These non-volatile substances are removed from the circuit by blowing down. Waste water and steam also occur in the water-steam circuit, in particular during start-up and shutdown of the steam plant, as a result of removed water, which does not contain any impurities but is nevertheless largely discarded and not used further. In the process the circuit loses water which has to be re-supplied by make-up water, or what is known as deionized water. The replenished deionized water has high oxygen and carbon dioxide contents which require degassing of the deionized water, so the start-up time of the steam plant is extended. Costs also result and the environment is polluted.

It is known that with the steam drum of an individual pressure level the blown down water is relaxed in a separator tank and water and steam are separated from each other. The separated steam is subsequently conveyed at low pressure into a collecting tank for degassing and heating of water contained therein. The separated contaminated water is treated in a water treatment plant and subsequently supplied to the water-steam circuit. It is also known that water removed from steam conduits is supplied to the turbine condenser directly or via separator bottles.

SUMMARY OF THE INVENTION

The object of the invention is to allow removal of water from a steam plant in a technically effective manner, wherein pollution of the environment should be low. In particular no contaminated water should be discharged and water should be employed sparingly.

This object is achieved according to the invention by a method and a device for removing water from a steam plant, wherein according to the degree of impurity of a number of partial volumes of water, a separate collection of the relevant partial volumes of water is carried out. This object is also achieved by a steam plant comprising a device according to the invention. According to the present invention the possibility is advantageously created of significantly reducing the amount of waste water. Environmental conditions are met more easily as a result. In addition less deionized water has to be replenished.

The method according to the invention and the associated device can be used for steam plants with or without steam drums (for example a once-through boiler). With a steam plant without a steam drum only blowing down and/or subsequent purification is omitted.

The advantage of the invention, in particular with respect to introduction of the removed water directly into a condenser, lies in the fact that the condenser does not have to be used to receive water or steam when the steam plant is stopped. Particularly large volumes of removed condensation water, which have to be conveyed into the water-steam circuit, accumulate in the event of stoppage.

In an advantageous embodiment of the invention a volume of water (for example drum blowdown) is removed from at least one steam drum and supplied to a water treatment plant. As a result a water-steam circuit of the steam plant can be cleaned and the recovered clean water can be fed in.

A further volume of water (for example removed condensation water or steam) is advantageously removed from at least one superheater and/or a steam conduit. This ensures that water that has collected in these components and cannot be processed by the turbine is also returned into the circuit.

This further volume of water can be supplied to the water-steam circuit of the steam plant without prior water treatment, so the accumulation of waste water can be kept low.

In a particularly advantageous configuration of the invention the water removed from the steam drum is subjected to a first water-steam separation and the separated and concentrated water is supplied to a water treatment plant. The separated, clean steam and the further volume of water removed from the at least one superheater and/or steam conduit are supplied to a second water-steam separation. As a result the volume of water which has to be purified is minimized.

The water separated in the first and/or second water-steam separating plant is advantageously supplied to the storage tank. This water is clean and does not need to be treated further in order to be fed into the water-steam circuit again.

The steam separated in the first and/or second water-steam separation plant is particularly advantageously supplied to a condenser. The steam is consequently easily returned into the water-steam circuit.

The water contained in the storage tank is advantageously stored isolated from the ambient air. The storage tank is sealed in other words. There can be no invasion or intake of air. As a result no oxygen enrichment takes place in the water, so expensive degassing is avoided and quick starting up of the steam plant is possible.

BRIEF DESCRIPTION OF THE DRAWINGS

Two embodiments of the invention will be described in more detail hereinafter with reference to the accompanying schematic drawings, in which.

Identical reference numerals will be used throughout hereinafter for identical elements and elements with the same function.

DETAILED DESCRIPTION OF THE INVENTION

Figure 1:
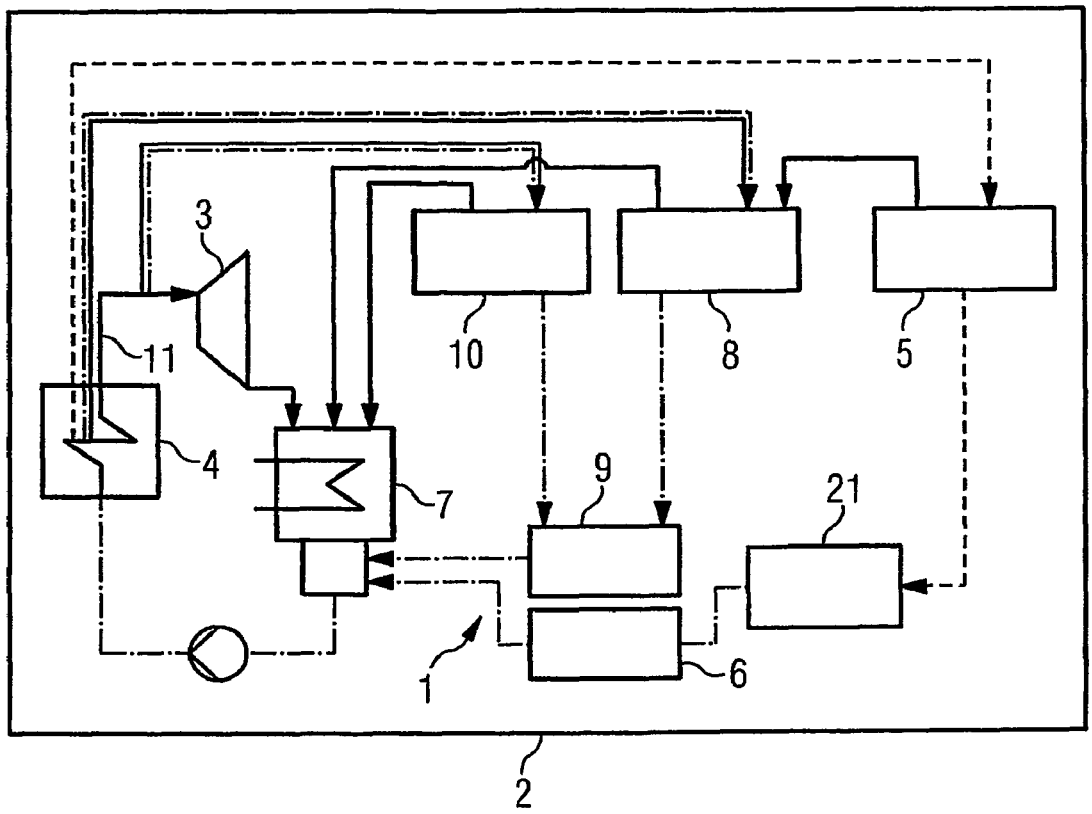
FIG. 1 shows a first embodiment of a water removal device according to the invention of a steam plant comprising one steam drum.

FIG. 1 shows a first embodiment of a water removal device 1 according to the invention which forms part of a steam plant 2 for generating power. The water removal device 1 is sealed from the atmosphere to prevent the invasion of air into the water-steam circuit of the steam plant 2. The various components of the steam plant 2 illustrated in FIG. 1 are connected to each other by means of conduits for transferring water or steam. Broken connecting lines denote conduits for contaminated water, dot-dash connecting lines denote conduits for clean water, and solid connecting lines denote conduits for clean steam.

The steam plant 2 contains one or more steam turbines 3, the steam of which is supplied via a superheater. FIG. 1 shows a combination of superheater and evaporator with reference numeral 4. The water removal device 1 includes a tank which is configured as a separator tank 5 for the water-steam separation. An ingress of the separator tank 5 is connected via a conduit to an egress of the evaporator/superheater combination 4. A first partial volume of blown down, contaminated water is discharged from the superheater via this conduit into the separator tank 5 and relaxed in order to concentrate the blowdown water further and to separate clean water in the form of steam from the contaminated water. The separated, contaminated and more concentrated water in separator tank 5 is conveyed via a conduit into a regenerating tank in the form of a blowdown tank 21 and is treated in a purification plant or water treatment plant 6. The treated water can be supplied to a condenser 7 of the steam plant 2 for re-use. The steam separated in the separator tank 5 does not contain any impurities and is introduced into a tank. The tank 8 is a relaxation and condensing tank which is connected to the evaporator/superheater combination 4 and into which removed, clean water is introduced from the superheater as a second partial volume of water. The tank 8 is kept at a slight overpressure compared with the environment by what is known as a steam cushion, so air or carbon dioxide is not carried into the water in the tank 8. A water-steam separation also takes place in the tank 8 with the separated water being supplied to a tank 9 which is used as a condensation water storage tank. The separated steam is supplied via a suitable conduit to the condenser 7. The water removal device 1 also comprises a tank 10, of which the ingress is connected to a steam conduit 11 via a water removal conduit to supply steam to the steam turbine 3. Water may be removed from this steam conduit 11 in particular on start-up and shutdown of the steam plant 2 in that the water removed during water removal as a third partial volume of water is fed to the tank 10. The water resulting during this water removal is clean. The tank 10 is a relaxation and condensing tank in which water-steam separation takes place. The separated, clean water is supplied to the tank 9 and the separated, clean steam is supplied to the condenser 7. The condensation water supplied to the tank 9 is temporarily stored with exclusion of air, in particular with the aid of auxiliary steam, and if required is supplied to the water-stream circuit again by feeding it into the condenser 7.

The steam introduced from the tanks 8 and 10 into the condenser 7 is condensed in the condenser 7 during operation of the steam plant 2. When the steam plant 2 has stopped or the condenser is unavailable the connecting conduits from tank 8 and from tank 10 to the condenser 7 are closed and the steam is cooled by a steam plant 2 cooling water system, condensed and the condensation water supplied to tank 9. The water in the condenser 7 is pumped via a hotwell into the steam drum of the steam drum/superheater combination 4 and the generated steam is subsequently supplied via the superheater to the steam drum/superheater combination 4 of the steam turbine 3.

It is thus possible to extensively use energy contained in the water-steam circuit, as well as the waste water accumulating as a result of water removals and blowdowns and steam, during operation, stoppage, and during start-up of the steam plant.

In the present embodiment the second tank 8 was used to receive water from the steam drum/superheater combination 4. The tank 10 was used to receive water from the steam conduit 11. It is also possible to supply both the water from the steam drum/superheater combination 4 and the water from the steam conduit 11 to a common tank, wherein a water-steam separation may then be performed.

Figure 2:
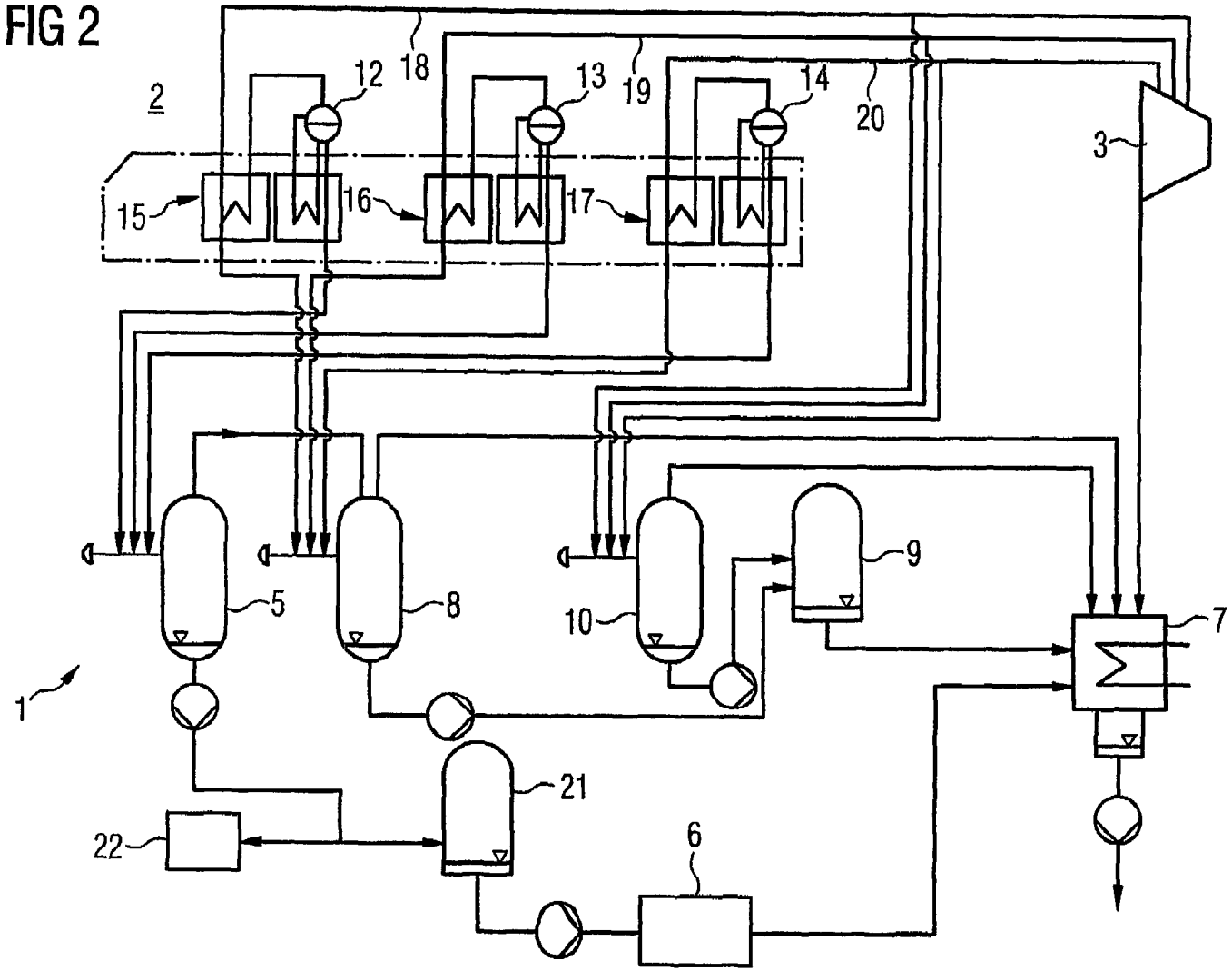
FIG. 2 shows a second embodiment of the water removal device according to the invention of the steam plant comprising three steam drums which have different pressure levels.

FIG. 2 shows a second embodiment of the water removal device 1 according to the invention. The water removal device 1 forms part of the steam plant 2 which in this case comprises three steam drums with different pressure levels. The steam plant 2 contains a high-pressure (HP) steam drum 12 with a HP pressure level, a medium-pressure (MP) steam drum 13 with a MP pressure level, which is lower than the HP pressure level, and a low-pressure (LP) pressure drum 14 (sic) with a LP pressure level, which is lower than the MP pressure level. During operation steam is generated from water by the steam drums 12, 13 and 15 and associated evaporators. This steam is supplied via the steam drums 12, 13, 14 of the superheaters 15, 16, 17, associated with different pressure levels, and steam conduits 18, 19, 20 to the steam turbines 3 of the steam plant 2.

The three steam drums 12, 13, 14 are each connected to the separator tank 5 to introduce blown down, contaminated water therefrom. The separated, contaminated water in the separator tank 5 is fed to a blowdown tank 21 for storing the contaminated water. This blowdown tank 21 can also be supplied with further contaminated liquids. The purification plant 6 receives contaminated liquid from the blowdown tank 21, which liquid is treated in the purification plant 6. The treated water can subsequently be fed to the condenser 7. The separator tank 5 is also connected at the egress-side to an untreated water tank 22. The three superheaters 15, 16, 17 are each connected to the tank 8 for introduction of clean water or steam that occurs during water removal therefrom. The three steam conduits 18, 19, 20 are in turn each connected to the tank 10 for introduction of clean water or steam that occurs during water removal therefrom.

The basic construction and the basic mode of operation of the water removal device 1 according to this second embodiment correspond to those of the first embodiment according to FIG. 1. The construction and the mode of operation of the separator tank 5, tank 8, tank 9, fourth tank 10 and purification plant 6 as well as the construction of the connecting conduits between these components and the further components of the steam plant 2 in particular correspond to the construction and mode of operation as have been described above with reference to the first embodiment.

The invention claimed is:

1. A method for removing water from a steam cycle of a steam turbine power plant, comprising:

removing a volume of water from a steam conduit or superheater of the steam plant;

determining the purity of the removed water; and storing a partial volume of the removed water in a storage tank based upon the purity of the removed water.

2. The method according to claim 1, wherein a plurality of storage tanks are used and an individual tank is selected based upon the purity of the water stored within.

3. The method according to claim 2, wherein a second volume of water is removed from a superheater or a steam conduit and is supplied to a water-steam circuit of the steam plant without previous water treatment.

4. The method according to claim 3, wherein a volume of water is removed from a steam drum and supplied to a water treatment plant.

5. The method according to claim 4, wherein steam is separated from the volume of water removed from the steam drum and the separated water is supplied to the water treatment plant.

6. The method according to claim 5, wherein the separated steam and the volume of water removed from the superheater or steam conduit is supplied to a second water-steam separation.

7. The method according to claim 6, wherein the separated water from the second water-steam separation is supplied to one of the storage tanks.

8. The method according to claim 7, wherein the separated steam from the second water-steam separation is supplied to a condenser.

9. The method according to claim 8, wherein the stored water is isolated from ambient air.

10. A device for removing water from a steam plant, comprising:

a plurality of storage tanks for storing partial volumes of water arranged such that partial volumes of water with different degrees of impurities are collected separately from each other; and a superheater and steam conduit each connected to one of the storage tanks that supplies a volume of removed water to the storage tank.

11. The device according to claim 10, wherein a steam drum and a device for treating contaminated water are provided and connected to each other for supplying a volume of water removed from the steam drum.

12. The device according to claim 11, wherein the steam drum is connected to a first separating device for supplying separated water and to a second separating device for supplying separated steam.

13. The device according to claim 12, wherein the second separating device is connected to the storage tank for supplying the separated water and to a condenser for supplying the separated steam.

14. The device according to claim 13, wherein the storage tanks are sealed tanks.

15. A steam plant, comprising:

a low pressure steam drum having steam with a steam pressure;

a medium pressure steam drum having steam with a greater steam pressure than the low pressure steam drum;

a high pressure steam drum having steam with a greater steam pressure than the medium pressure steam drum;

a steam conduit that connects the steam drums to a water removal device wherein the water removal device comprises:

a plurality of storage tanks for storing partial volumes of water such that water of different purity is collected separately from each other; and a steam turbine connected to the steam conduit.

* * * * *